US006003668A

United States Patent [19]

Joyce

[11] Patent Number: 6,003,668

[45] Date of Patent: Dec. 21, 1999

[54] CONTAINER FOR STORING AND DISPENSING ROLL SHEET PRODUCTS

[76] Inventor: Michael Kevin Joyce, 302 Clark Dr., Marietta, Ohio 45750

[21] Appl. No.: 09/064,073

[22] Filed: Apr. 22, 1998

[51] Int. Cl.[6] ..... B65D 85/672

[52] U.S. Cl. ..... 206/397; 206/408; 206/409

[58] Field of Search ..... 206/389, 397, 206/407–409, 446, 413, 414, 415, 416; 242/160.1, 160.4, 170, 588.6

[56] References Cited

U.S. PATENT DOCUMENTS

| | | | |
|---|---|---|---|
| 4,821,876 | 4/1989 | Naito et al. | 206/407 |
| 5,533,621 | 7/1996 | Schoal, Jr. | 206/409 |
| 5,593,035 | 1/1997 | Taylor et al. | 206/409 |
| 5,704,479 | 1/1998 | Barnett et al. | 206/409 |
| 5,806,786 | 9/1998 | Abe et al. | 206/408 |
| 5,819,935 | 10/1998 | Lawson | 206/409 |
| 5,873,481 | 2/1999 | Gruhn et al. | 206/409 |

*Primary Examiner*—Paul T. Sewell
*Assistant Examiner*—Luan K. Bui
*Attorney, Agent, or Firm*—Jason H. Foster; Kremblas, Foster, Millard & Pollick

[57] ABSTRACT

A round shell, flat base container with a closure end on either end, having along one side, an access lid (23) in which one accesses the interior of the container. Accessing the interior of the container reveals a removable internal axle assembly (FIG. 6) which is the rotating mechanism for dispensing and retrieving the roll sheeting. The internal axle assembly (FIG. 6) sets between the closure ends and is supported between a hand wheel and bearing assembly (FIG. 7) at one end and a slotted spindle guide (60) and friction bearing (62) at the other end. This complete assembly supports the roll of sheeting within the container and rotates it, to dispense or retrieve the sheeting. Located along the opposite side of the container is a dispensing slot lid (29), which gives access to an installed roll of sheeting when opened. This lid when closed forms a dispensing slot (26) and contains a cutting guide (28). This slot is where the roll sheeting is dispensed from or retrieved too. The cutting guide is the guide for cutting the sheeting to desired lengths. This container is portable and can be easily handled and transported by a series of lifting handles.

5 Claims, 5 Drawing Sheets

CONTAINER FOR STORING AND DISPENSING ROLL SHEET PRODUCTS

BACKGROUND—FIELD OF INVENTION

This invention relates to portable containers specifically for storing and dispensing roll sheet products used in residential, agricultural, commercial, and industrial applications.

BACKGROUND—DESCRIPTION OF PRIOR ART

Roll sheet products such as polyethylene plastic, felt roofing, tyvek and typar fabrics, papering, etc., are sold from supply stores and warehouses. These products are packaged for sale in materials such as paper, cardboard, and plastic. These packaging materials are suitable for containing the products up to the point of initial use. Normally these packaging materials are discarded once the products are removed and put to use.

Once removed, these roll sheet products are typically awkward to handle and use. However, a container as this will eliminate the awkwardness associated with handling these products, thus, providing a means to control how these products are stored and dispensed.

Currently there are no containers or dispensers for effectively controlling how roll sheet products such as the ones listed above are stored and handled. These products are currently removed from their initial packaging and unrolled as needed.

As an example, a product such as polyethylene sheeting, commonly known as "poly-film", is packaged in various sized rolls. Poly-film is used by homeowners and contractors alike for covering materials and items for the purpose of protection. Poly-film is used to protect materials and items around a home or a jobsite that could be damaged from the weather or from dirt, dust, paint, etc. Poly-film is also used for partitioning, for ground and earth controls, for landscaping, to cover equipment, etc. Contractors seem to use poly-film sheeting in larger quantities and more frequently, therefore, they tend to purchase larger quantities and larger sized rolls. Many times a roll that is purchased is not totally expended, thus, there is roll sheet product left over and this material has to be stored for future use.

Without currently having a container for handling products such as these roll sheet products, one has to find whatever convenient means is available for securing unused portions of the products. This is normally accomplished using string or tape or some type of clip to secure the product. In addition to this inefficient way of securing these products, they are still exposed to potentially damaging elements. These can include the weather and sun, and contaminations from over-spray, dust, vapors, etc. While these "storage associated" problems exist, there is also the consideration of actually dispensing and retrieving these roll sheet products. Currently they are rolled out from a fixed point. The leading edge of the roll is secured and the roll is then unrolled across a surface or floor to a desired length. The product is then cut to length and the balance of the unrolled product is rolled back up by re-rolling the roll back across the surface. This requires a large area and creates a cumbersome means for performing this task. In addition, the product can be contaminated or damaged from the surface it is rolled across. The unused portion also has to be re-secured as described above and made ready for the next application or task.

OBJECTS AND ADVANTAGES

Accordingly, the objects and disadvantages of the current means for handling the roll sheet products described above can be overcome by the objects and advantages of the present invention being:

(a) to provide an immediate means for storing roll sheet products within an enclosed container, ready for use at the discretion of the user;

(b) to provide a container constructed of a material for protection of the roll sheet product being stored, that can be pigmented in multiple colors to identify different products being stored for various applications;

(c) to provide a container constructed of a material that resists UV (ultra-violet) rays, thus protecting the roll sheet product from being exposed and damaged by UV rays, as well as other weather elements such as precipitation, freezing, and wind;

(d) to provide a container constructed of a material capable of withstanding damage from dropping, sliding, and general abuse associated with the use of these type materials:

(e) to provide a container with lifting handles that allow a person or persons to easily lift and transport the container and the product inside;

(f) to provide a container which provides for easy access into the container to a rotating mechanism, allowing for the simple installation of the roll sheet product;

(g) to provide a container which utilizes an interior rotating mechanism that allows for easy installation of various sized rolls of the roll sheet product;

(h) to provide a container which utilizes an interior rotating mechanism for efficient and precise dispensing of the product, as well as the ability to re-roll the unused length of the remaining roll back into the container;

(i) to provide a container which allows for the controlled dispensing of the roll sheeting, eliminating the roll from freewheeling and unrolling itself;

(j) to provide a container which allows for dispensing of the roll sheeting in a small confined area;

(k) to provide a container which is typically portable, but one that can also be fixed in place for repetitious dispensing of the product;

Further objects and advantages of the present invention will include the ability to easily engineer, produce and market this container and make it readily available for purchase from supply warehouses to the consumer. In addition, this container will be constructed of a material that is durable and will withstand many uses. Once purchased this container will allow the consumer to use and re-use the container many times with many different roll sheet products. This container can be easily marketed alongside the various types of roll sheet products sold at industrial warehouses, commercial supply companies, lumber yards and discount hardware and garden centers. This container is consumer friendly with it's simple but efficient operation. This container will allow the user or contractor to better regulate the amount of roll sheeting being purchased and used, by better control over waste and loss due to inefficient dispensing of the product, as well as product damage due to direct exposure to the hazards of the work place. In addition, the manufacturers will sell more of their product in larger quantities because the user or contractor will have a better means for storing the product. The user or contractor will buy a larger roll at a better unit price as opposed to purchasing a smaller roll at a higher unit price. Further objects and advantages will become apparent with consideration of the ensuing description and drawings.

DRAWING FIGURES

The following drawings include the main components by figure and the integral parts of the main components are noted by reference number.

FIG. 1 illustrates an isometric rear view of the container with a hand wheel and a closed access lid.

FIG. 2 illustrates an isometric front view of the container with a dispensing slot and a closed dispensing slot lid.

FIG. 3 illustrates the hand wheel, end view with the access lid and the dispensing slot lid opened.

FIG. 4 illustrates a rear side view of the container with an internal axle assembly installed without a roll of sheeting.

FIG. 5 illustrates an isometric rear view of the container with the access lid opened and the internal axle assembly removed. A slotted spindle guide and a friction bearing can also be seen at the end.

FIG. 6 illustrates the internal axle assembly.

FIG. 7 illustrates a hand wheel and bearing assembly.

FIG. 8 illustrates a dampening assembly.

FIG. 9 illustrates the internal axle assembly inserted within a roll of sheeting being compressed between a stationary compression mandrel and guide wheel and an adjustable compression mandrel and guide wheel.

FIG. 10 illustrates a rear side view of the container with the access lid open and the internal axle assembly inserted into a roll of sheeting and inserted into the container.

Figure 1:
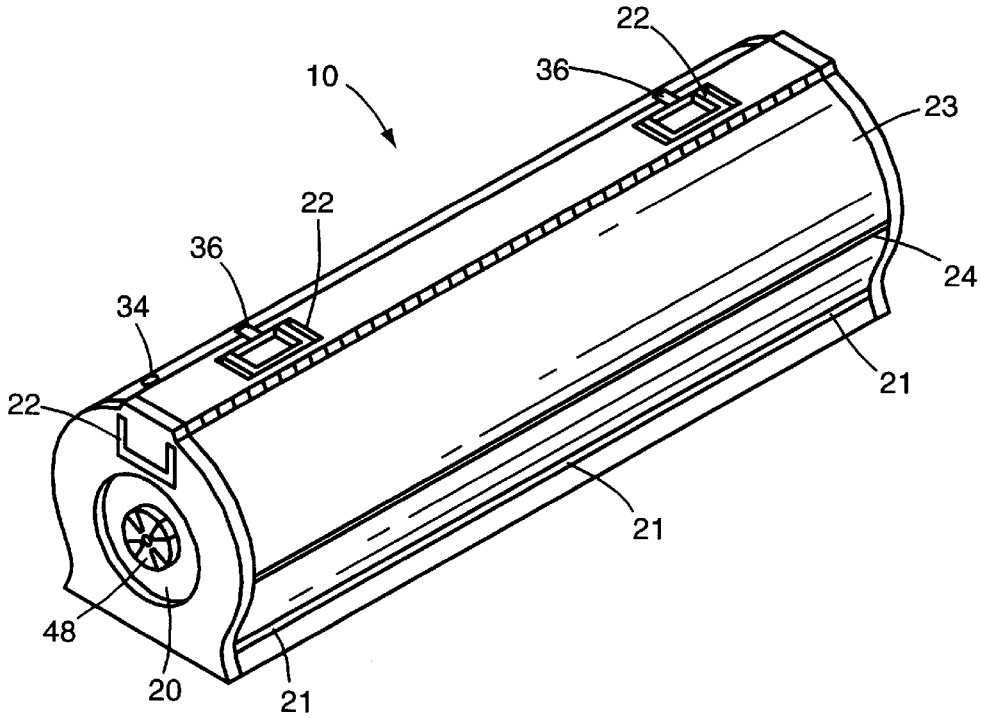
FIG. 1 through FIG. 10 shows various main component views and aspects of a container/dispenser, to be known as the "container", and their respectful location to each other.

Reference Numerals in Drawings:

| | |
|---|---|
| 20 Hand Wheel Recess | 21 Anchor Holes |
| 22 Lifting Handles | 23 Access Lid |
| 24 Access Lid Hinge | 26 Dispensing Slot |
| 28 Cutting Guide | 29 Dispensing Slot Lid |
| 30 Dispensing Slot Lid Hinge | 32 Catch Latches |
| 34 Dampening Button | 36 Draw Latches |
| 38 Spindle | 40 Connecting Adapter |
| 42 Stationary Compression Mandrel & Guide Wheel | 44 Centering Arbor |
| 46 Adjustable Compression Mandrel & Guide Wheel | 48 Hand Wheel |
| 50 Connecting Stem | 52 Alignment Bearing |
| 54 Dampening Shaft | 56 Alignment Bracket |
| 58 Adjustable Tensioner | 60 Slotted Spindle Guide |
| 62 Friction Bearing | |

SUMMARY

The present invention is a container for dispenser roll sheet products which consists of a base and shell enclosure with openings and lids for installing and dispensing roll sheeting, utilizing a rotating internal axle assembly.

Description—FIGS. 1 thru 10

Figure 2:
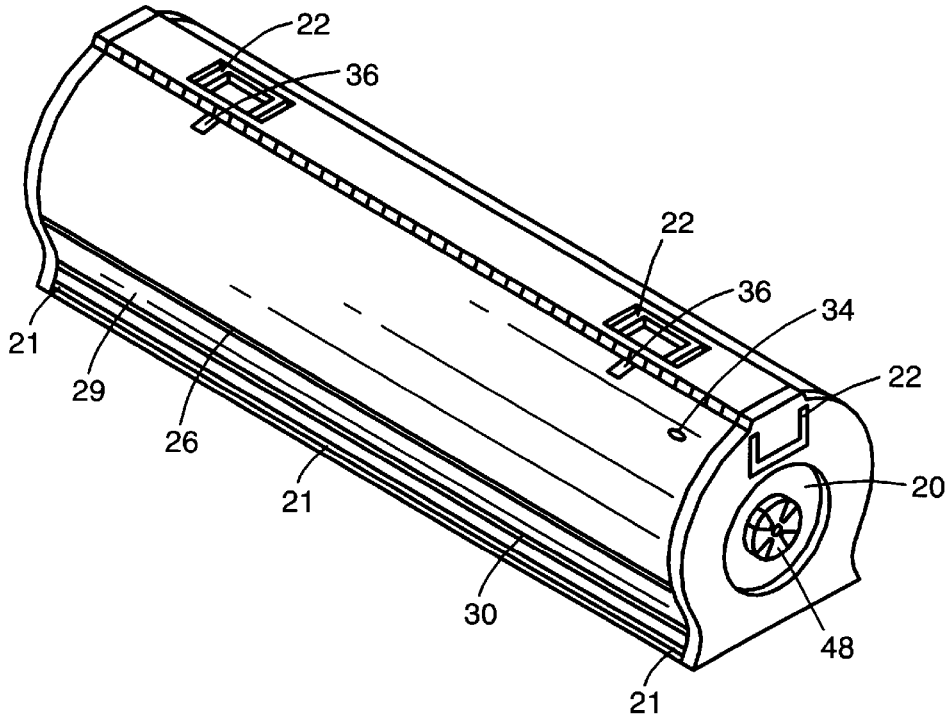
Figure 3:
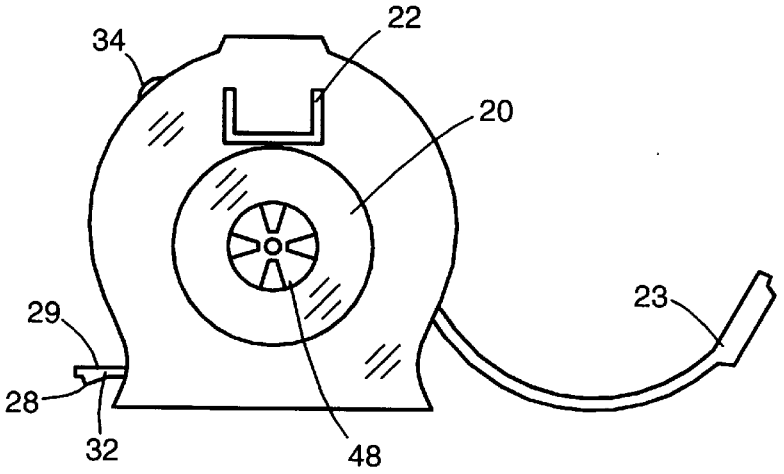

An embodiment of the container/dispenser or the "container" 10 of the present invention is illustrated in an isometric rear view (FIG. 1) and an isometric front view (FIG. 2). Upon examining the rear view (FIG. 1), a hand wheel (48) can be seen projecting through the end of the container while being protected by a hand wheel recess (20). Lifting handles (22) can be seen across the top of an access lid (23) as well as on the end just above hand wheel (48). Access lid (23) can also be viewed in the closed position and is secured by draw latches (36) and an access lid hinge (24). Upon rotating the container 180 degrees, a front view (FIG. 2) can be seen and a dispensing slot (26) along with a dispensing slot lid (29) and a cutting guide (28) can be viewed in the closed position. Another lifting handle (22) can also be seen from this end. Dispensing lid (29) is secured by catch latches (32) and a dispensing slot lid hinge (30). The main body and components of this container could be constructed from a high-density plastic such as a polyethylene or a fiberglass reinforced plastic (FRP) for durability. However, the hinge pins, latch wires, and the cutting guide may be constructed of an alternative material for strength and wear resistance such as steel. These two views also show anchor holes (21) that can be used for securing the container in place, if needed.

Figure 6:
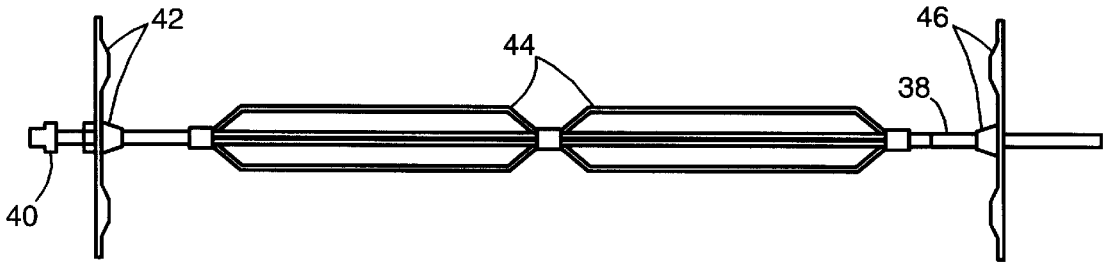
Figure 7:
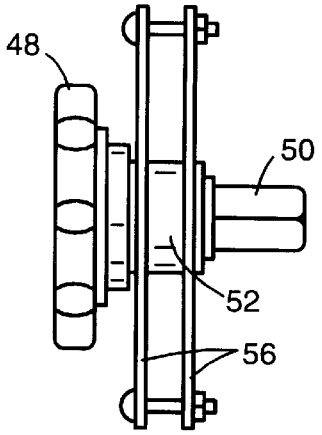

The hand wheel, end view (FIG. 3) shows the container with access lid (23) and dispensing lid (29) in the open position. The open access lid (23) allows the user to install or remove a roll of sheeting. Dispensing lid (29) allows the user to easily access the leading edge of the roll sheeting in order to project it into dispensing slot (26). The rear side view (FIG. 4), with access lid (23) in the open position reveals an axle assembly (FIG. 6) installed without a roll of sheeting. This view also shows the axle assembly (FIG. 6) secured at the hand wheel end of the container through a connecting adapter (40) and a connecting stem (50) of a wheel and bearing assembly (FIG. 7). At the other end of the axle assembly (FIG. 6) is a spindle (38) that is directed in place through a slotted spindle guide (60) and is seated into a friction bearing (62) located in rightward the end of the container 10. Friction bearing (62) will typically be fabricated of a wear resistant material such as brass, plastic or teflon. This is typical of how the container will appear upon the initial purchase, prior to the installation of the first roll of sheeting.

The axle assembly (FIG. 6) is the main mechanism for the operation of the invention. This assembly consists of spindle (38) that other components are attached to. At the left end of this assembly, as shown, connecting adapter (40) is the part responsible for connecting the axle assembly (FIG. 6) to the container for operation. Also attached to spindle (38) is a stationary compression mandrel and guide wheel (42) that the roll of sheeting butts up against. Spindle (38) also has a centering arbor (44) for keeping spindle (38) centered inside the roll of sheeting. The right-end of this assembly, as shown, includes an adjustable compression mandrel and guide wheel (46) that can be removed to install a roll of sheeting. Adjustable mandrel and guide wheel (46) can then be re-installed on spindle (38) and tightened against the end of a roll of sheeting. The mandrels have a non-slip, tapered surface that wedges into the ends of the roll sheeting and compresses the center tube to contain the roll of sheeting.

The wheel and bearing assembly (FIG. 7), is the mechanism that actuates the axle assembly (FIG. 6) for re-rolling the roll of sheeting back into the container. The wheel and bearing assembly (FIG. 7) consists of hand wheel (48) that is attached to connecting stem (50). Connecting stem (50) is supported and secured through an alignment bearing (52). The end of connecting stem (50) is coupled with connecting adapter (40) at the end of the axle assembly (FIG. 6). Alignment bearing (52) supports connecting stem (50) and also aligns connecting stem (50) with connecting adapter (40) to insure straight and true alignment of the axle assembly (FIG. 6) through the container to the friction bearing (62) at the opposite end of the container.

Figure 4:
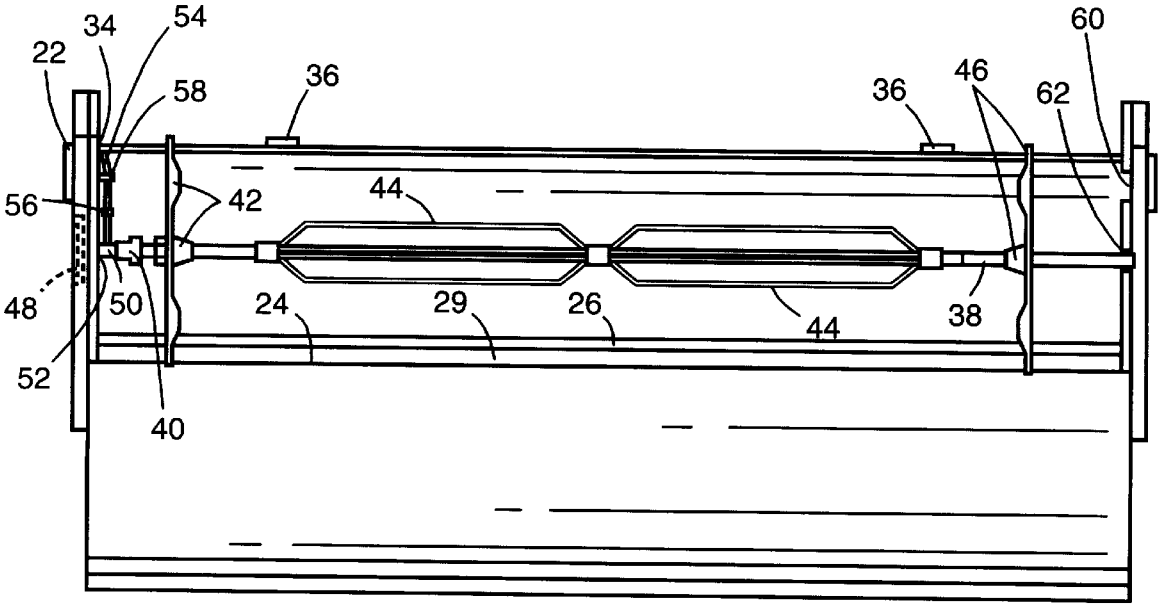

Directly adjacent to the wheel and bearing assembly (FIG. 7), is a dampening assembly (FIG. 8), which is used for adjusting the rotation of connecting stem (50). This dampening assembly (FIG. 8) has an alignment bracket (56) which is mounted in a conventional manner to the end of the container 10 as shown in FIG. 4, that secures and aligns a dampening shaft (54) between the shell of the container and connecting stem (50). This dampening assembly (FIG. 8) operates under tension, exerted by the coil spring (57), which is interposed between one ear of the bracket (56) and an adjustable tensioner (58). The spring (57) generates a force that is exerted against connecting stem (50) by the end of the dampening shaft (54). The tension is adjusted by an adjustable tensioner (58) which is preferably an internally threaded nut located on dampening shaft (54) and between the two support ears of alignment bracket (56). At the opposite end of dampening shaft (54) is a dampening button (34) that projects through the shell of the container. This dampening assembly (FIG. 8) can be used as a brake. This button can be pressed to increase pressure on connecting stem (50) or it can be pulled to allow connecting stem (50) to spin freely. The friction force between the contacting tip of the shaft (54) and the stem (50) tends to dampen, and thereby adjust, the rotation of the stem (50) and the attached axle assembly.

The axle assembly (FIG. 6) shown in (FIG. 9) of the drawings illustrates a roll of sheeting installed over spindle (38) and supported and centered by centering arbor (44). The roll of sheeting is being compressed between stationary mandrel and guide wheel (42) and adjustable mandrel and guide wheel (46). This assembly is ready to be installed into the container.

The axle assembly (FIG. 6) with the roll of sheeting installed between the mandrels is loaded into the container illustrated in (FIG. 10) of the drawings with access lid (23) open. The axle assembly (FIG. 6) is supported between the wheel and bearing assembly (FIG. 7) and friction bearing (62). Access lid (23) is ready to be closed and secured by draw latches (36).

Figure 11:
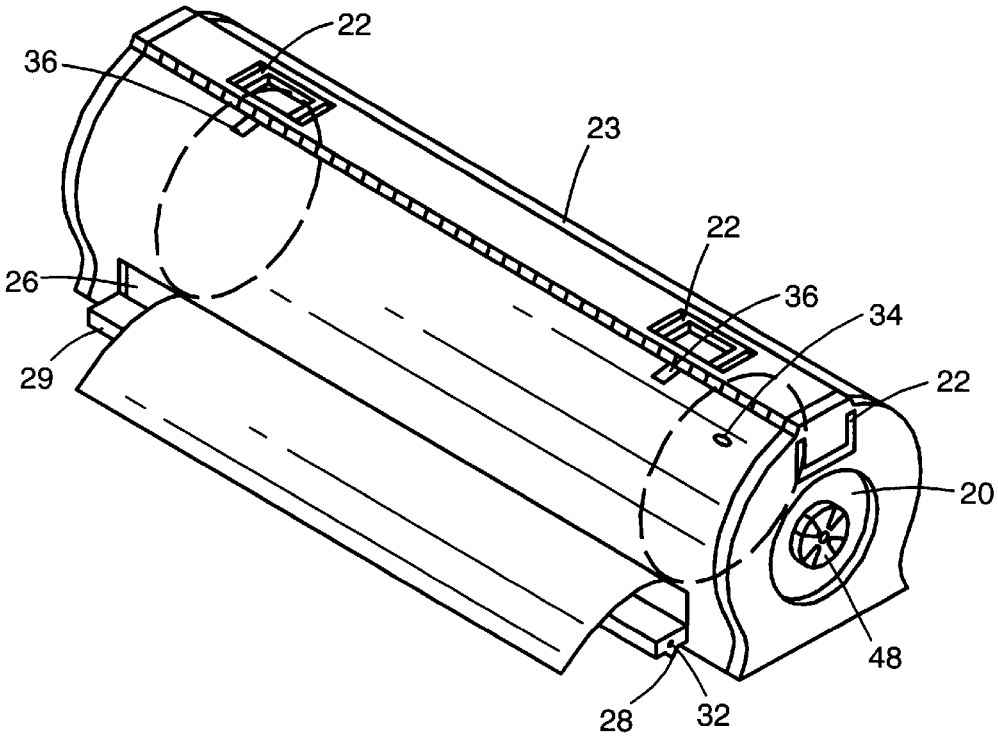
FIG. 11 illustrates an isometric front view of the container with the dispensing slot lid opened and the leading edge of the roll of sheeting projecting out.

The container is now ready for use as illustrated in (FIG. 11). This figure shows the front view of the container with dispensing lid (29) partially open. With dispensing lid (29) in this position the operator simply rotates hand wheel (48) which in-turn rotates the axle assembly (FIG. 6) and the roll of sheeting until the leading edge of sheeting is visible. When the leading edge is visible, it can then be pulled into dispensing slot (26). Once the leading edge is projected into dispensing slot (26), dispensing lid (29) can be closed and secured by catch latches (32). The roll of sheeting is now ready to be dispensed as needed.

From the description above, a number of advantages of my container for dispensing roll sheeting become evident.

(a) Various types of roll sheet products can be stored and dispensed from this container.

(b) This container allows the user to immediately install and secure a roll of sheeting for immediate or future use.

(c) The installed roll of sheeting is protected from the weather elements, as well as from conditions normally found at project sites during the use of these products.

(d) The installed roll of sheeting can be maintained in its original form, secured within the container and held firmly between the two mandrel assemblies.

(e) The installed roll of sheeting can be easily dispensed and retrieved as needed through the dispensing slot by simply actuating the hand wheel and axle assemblies.

(f) The installed roll of sheeting and the container can be indefinitely stored indoors or outdoors for future use.

Operation

The manner of using this container for storing and dispensing roll sheet products is to allow the user to simply position the container as illustrated in (FIG. 1) and open access lid (23) of the container as illustrated in (FIG. 4). Once in this position, the axle assembly (FIG. 6) is now ready to be removed.

Figure 5:
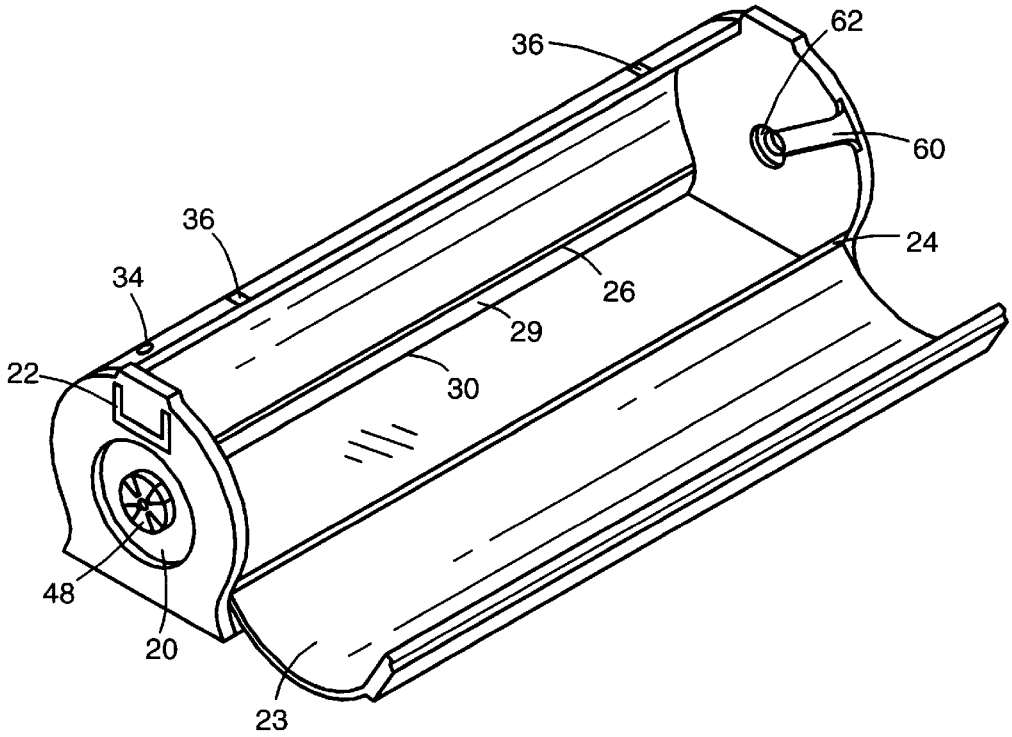

With the container resting in a secure position on a workbench, a tailgate or on the ground, the user removes the axle assembly (FIG. 6) from the container. The container then appears as illustrated in (FIG. 5). The user then removes a roll of sheeting from its packaging and sets it on the open, interior side of access lid (23). Once the roll of sheeting is resting on access lid (23), the user simply removes adjustable mandrel and guide wheel (46) from spindle (38) of the axle assembly (FIG. 6). Spindle (38) is then inserted into the end of the center tube of the roll of sheeting resting on access lid (23). Spindle (38) and centering arbor (44) are then pushed through the center tube of the roll, up tight against stationary mandrel and guide wheel (42). Adjustable mandrel and guide wheel (46) is now ready to be reinstalled on spindle (38) and tightened against the opposite end of the roll of sheeting.

Figure 9:
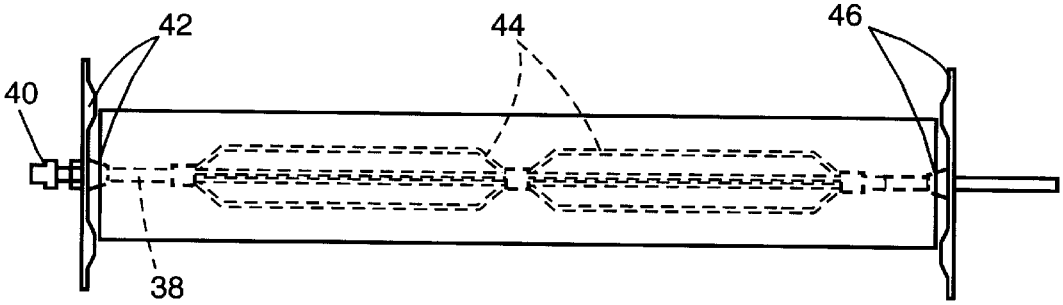

The axle assembly (FIG. 6) and the roll of sheeting are now ready to be installed in the container as illustrated in (FIG. 9).

Figure 10:
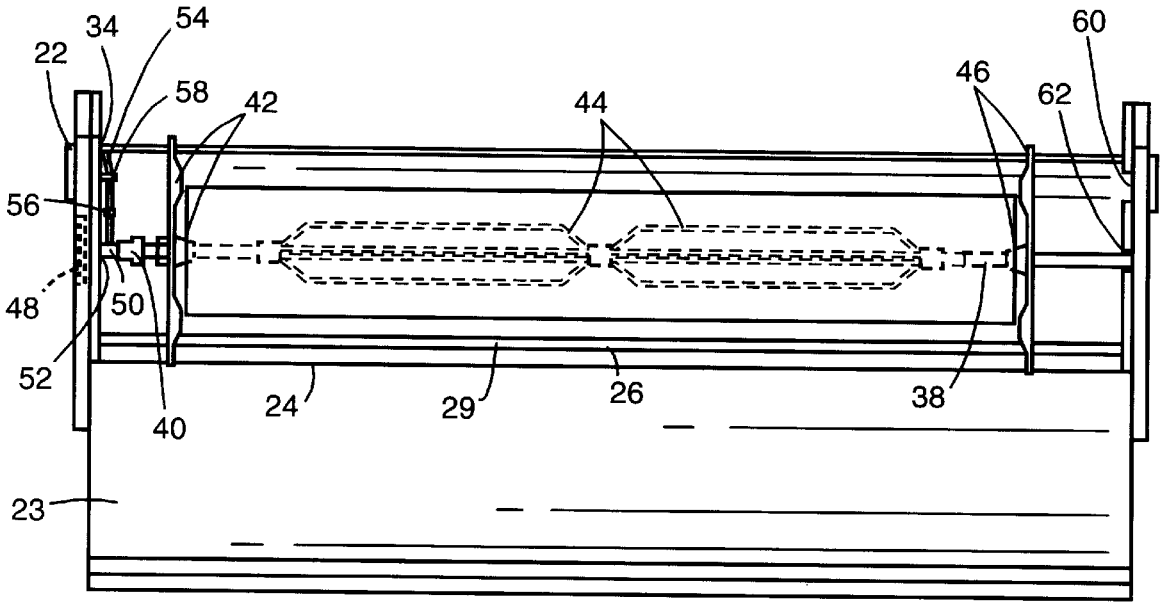

The user is positioned directly in front of access lid (23) and directly over the axle assembly (FIG. 6) and the roll of sheeting. Once in this position the user lifts the axle and the roll of sheeting up and positions it on a slight angle with connecting adapter (40) leading into the container. Connecting adapter (40) is centered in front of connecting stem (50) and is then coupled with connecting stem (50). The end of spindle (38) located at the adjustable end of the axle assembly (FIG. 6) follows and slides into slotted spindle guide (60) and rests on friction bearing (62) as illustrated in (FIG. 10). Access lid (23) is then closed and secured in place by draw latches (36) and the container once again appears as illustrated in (FIG. 1).

The container is positioned as illustrated in (FIG. 2) by grasping lifting handles (22) and spinning the container 180 degrees. The position illustrated in (FIG. 2) now allows the user to access dispensing slot (26) by opening dispensing lid (29). Once dispensing lid (29) is opened, the user can now spin the roll of sheeting by turning hand wheel (48). This in-turn rotates connecting stem (50) through alignment bearing (52), thus rotating the axle assembly (FIG. 6) and the roll of sheeting. The user will now find the leading edge of the sheeting and grasp it through the opening. The leading edge can then be pulled and projected into dispensing slot (26). Dispensing lid (29) can then be closed and secured by catch latches (32) located on each end of the lid. After the lid is closed and secured the leading edge of the sheeting projects through dispensing slot (26) and lays over cutting guide (28). The sheeting is now ready to be dispensed.

With the leading edge of the sheeting projecting out of the container the user grasps the leading edge and pulls out the desired length of sheeting. After pulling out the desired length, the user can then use a knife to cut the sheeting. Cutting guide (28) allows the user to cut against a straight edge making a clean, straight cut. However, the user does not have to cut against cutting guide (28). The sheeting can be cut anywhere along the projected length. The balance of the sheeting projecting out of the container that is not cut can then be rewound back into the container. This is accomplished by rotating hand wheel (48) in the opposite direction rolling the sheeting back into the container.

Figure 8:
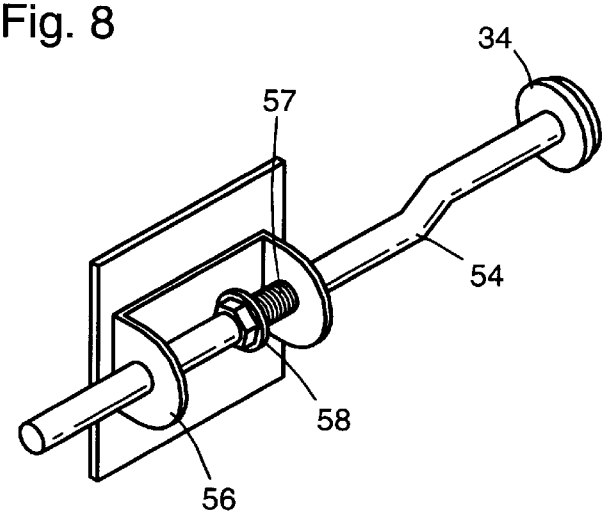

In the event, the user wishes to control the rotation of the roll of sheeting, the user simply increases the tension of dampening shaft (54) by tightening adjustable tensioner (58) located on the dampening assembly (FIG. 8). This will help keep the axle assembly (FIG. 6) and the roll of sheeting from freewheeling and unrolling itself.

Conclusions, Ramificatons and Scope

Accordingly, the reader will see that the container for storing and dispensing roll sheet products described in this invention can be effectively used for handling and dispensing roll sheeting. In addition the container can be used many times over and over and will be capable of handling many different types of roll sheeting. The various types of roll sheeting can be stored and maintained in like new condition inside the container. Once the roll sheeting is installed, the container can be transported to many locations. The container can be used on the ground, on a workbench, off the tailgate of a truck, up on a roof, etc. This container is extremely versatile for the many applications of its use. Furthermore, the container has the additional advantages in that

- it is portable, lightweight and can be moved by a single user.
- it can be attached to a work surface through the anchor holes for fixed applications
- it allows for simple and easy access for roll installation and removal through the large openings, the versatile lids and simple hardware components.
- it has simple, lightweight but very strong mechanical components for durability and long life, even after many uses
- it can be stored outside with little or no effect to the container, its mechanisms, or the roll sheeting stored
- it can be cleaned easily after long extensive use in dirty areas
- it can be repaired very easily should a component become damaged through wear or abuse Although the description above specifies many advantages to the present invention, it should not be construed as limiting the scope of this invention but as for providing the reader with some of the main embodiments of this invention to illustrate its usefulness. As an example, this container could be constructed of many other types of materials such as aluminum or other lightweight alloys and it could be formed in other shapes such as square or rectangular, etc. However, the materials and round shape proposed should make for a strong, durable container. This container could also have different internal parts for example, the dampening assembly could have a threaded positive stop, controlled by tightening a shaft against the hand wheel and bearing assembly to slow down the spin, or stop it altogether. The internal axle assembly could be constructed with the centering arbor made into a solid square bar as opposed to the wire type assembly shown here. This container could be constructed in a larger version to accommodate larger and heavier rolls of sheeting and fabrics used by highway departments, excavation contractors, high performance turf contractors, grounds keepers, etc. This larger version could also have various accessories such as lifting apparatus' adapted for use with different types of lifting equipment.

Thus, the scope of this invention should be determined by the appended claims and their legal equivalents as opposed to the examples given.

I claim:

1. A portable, rolled-material dispenser, comprising:

(a) an elongated housing including a base, sidewalls and endwalls;

(b) an axle removably and rotatably mounted to the endwalls of the housing for supporting rolled-material;

(c) a first compression mandrel mounted substantially perpendicularly to the axle and having a conical guide for inserting within a core of rolled-material;

(d) a second compression mandrel mounted substantially perpendicularly to the axle and having a conical guide for inserting within a core of rolled-material, the second compression mandrel being longitudinally spaced from the first compression mandrel with the conical guides of both compression mandrels facing one another, wherein the second compression mandrel is longitudinally adjustable relative to the first compression mandrel for permitting the interposition of one of a plurality of lengths of rolled-material between the compression mandrels.

2. A dispenser in accordance with claim 1, wherein the second compression mandrel has a threaded internal aperture that threadingly engages a threaded external surface of the axle, whereby longitudinal adjustment is effected upon rotation of the second compression mandrel on the axle.

3. A dispenser in accordance with claim 1, further comprising an adjustable dampener mounted to the housing and extending to frictional engagement with the axle.

4. A dispenser in accordance with claim 3, further comprising a centering arbor including rods mounted to the axle and extending radially from the axle for engaging the interior of a core on which rolled-material is mounted.

5. A dispenser in accordance with claim 4, further comprising a hand-grippable handwheel mounted in a cavity on the exterior of the housing and drivingly linked to the axle.

* * * * *